US009144300B2

(12) United States Patent
Cotey

(10) Patent No.: US 9,144,300 B2
(45) Date of Patent: Sep. 29, 2015

(54) APPLICATION PERTAINING TO AN ARTICLE THAT CAN BE SELECTIVELY TILTED AND ROLLED

(75) Inventor: Richard S. Cotey, Green Oaks, IL (US)

(73) Assignee: Medline Industries, Inc., Mundelein, IL (US)

( * ) Notice: Subject to any disclaimer, the term of this patent is extended or adjusted under 35 U.S.C. 154(b) by 0 days.

(21) Appl. No.: 13/523,415

(22) Filed: Jun. 14, 2012

(65) Prior Publication Data

US 2013/0333595 A1 Dec. 19, 2013

(51) Int. Cl.
*A47B 13/02* (2006.01)
*A47B 3/08* (2006.01)

(52) U.S. Cl.
CPC ..... *A47B 3/0815* (2013.01); *A47B 13/023* (2013.01); *A47B 2013/025* (2013.01)

(58) Field of Classification Search
CPC .... A47B 13/023; A47B 23/046; A47B 21/00; A47B 91/024; A47B 27/02; B60B 33/06; B60B 33/063
USPC ..... 108/7–9, 137, 150
See application file for complete search history.

(56) References Cited

U.S. PATENT DOCUMENTS

| | | | | | |
|---|---|---|---|---|---|
| 3,917,368 | A | * | 11/1975 | Gusdorf et al. | 312/351.2 |
| 4,339,842 | A | * | 7/1982 | Fontana et al. | 16/32 |
| 4,558,553 | A | * | 12/1985 | Kolk | 108/27 |
| 4,747,180 | A | * | 5/1988 | Screen | 16/35 R |
| 4,805,542 | A | | 2/1989 | Peterson et al. | |
| 4,828,208 | A | | 5/1989 | Peterson et al. | |
| 4,986,195 | A | * | 1/1991 | Diffrient | 108/150 |
| D332,712 | S | | 1/1993 | Schaen | |
| 5,365,862 | A | | 11/1994 | Peterson | |
| 6,055,704 | A | * | 5/2000 | Leibman | 16/35 R |
| 6,408,482 | B1 | * | 6/2002 | Henriott et al. | 16/29 |
| 6,591,449 | B1 | * | 7/2003 | Parkin | 16/35 R |
| 7,077,369 | B2 | * | 7/2006 | Hardin | 248/166 |
| 7,311,048 | B2 | * | 12/2007 | Kopala, Jr. | 108/147 |

* cited by examiner

*Primary Examiner* — Matthew Ing
(74) *Attorney, Agent, or Firm* — Fitch, Even, Tabin & Flannery LLP

(57) ABSTRACT

An article of furniture has a main body, a floor-engagement frame, a plurality of non-rolling floor-engagement members connected to the floor-engagement frame, and a plurality of rollers that are also connected to the floor-engagement frame. These rollers do not engage the floor when the article of furniture rests upon the floor in an ordinary state of usage but do engage the floor when the article of furniture is tilted at least fifteen degrees. The article can further comprise a pedestal that pivotally couples to the floor-engagement frame and that supports a table surface. A user interface can control a latch that holds the table surface perpendicular to the pedestal. Another user interface can control a latch that holds the table surface at a present vertical height when latched.

20 Claims, 5 Drawing Sheets

APPLICATION PERTAINING TO AN ARTICLE THAT CAN BE SELECTIVELY TILTED AND ROLLED

TECHNICAL FIELD

This invention relates generally to movable articles such as articles of furniture and in particular tables.

BACKGROUND

Articles of furniture comprise a generally well-understood area of endeavor. In many cases articles of furniture are statically placed; once placed in a specific location they are not moved during ordinary use. In other cases, however, the end user (such as an authorized attendant) will position and reposition the article of furniture on a more dynamic basis. This can comprise, for example, moving the article of furniture some considerable distance at least once a month or week or even multiple times in a single day.

The ease with which an attendant can move a given article of furniture varies with a variety of factors including the nature of the surface upon which the article rests. Whether the flooring is carpeted or comprises vinyl, stone tile, or wood, for example, can significantly impact how easily the end user can move the article of furniture.

Wheels (such as but not limited to casters) are sometimes employed to facilitate moving an article of furniture. Wheels, unfortunately, also make it easier to inadvertently move that same article of furniture at an inopportune time. It may be useful, for example, to provide wheels on the legs of a table to facilitate moving that table when desired. Those same wheels, however, make it considerably more likely that that table will be inadvertently and inappropriately moved at other times, too. For example, a person who is rising from their chair and who presses upon the table to assist themselves in rising may cause the table to roll on its wheels and hence move from a desired location.

A locking mechanism can of course be employed to lock such wheels from rolling. Such an approach, however, can lead to other concerns including overall ease of use, safety, and efficiency.

BRIEF DESCRIPTION OF THE DRAWINGS

The above needs are at least partially met through provision of the apparatus pertaining to an article that can be selectively tilted and rolled described in the following detailed description, particularly when studied in conjunction with the drawings, wherein.

Figure 1:
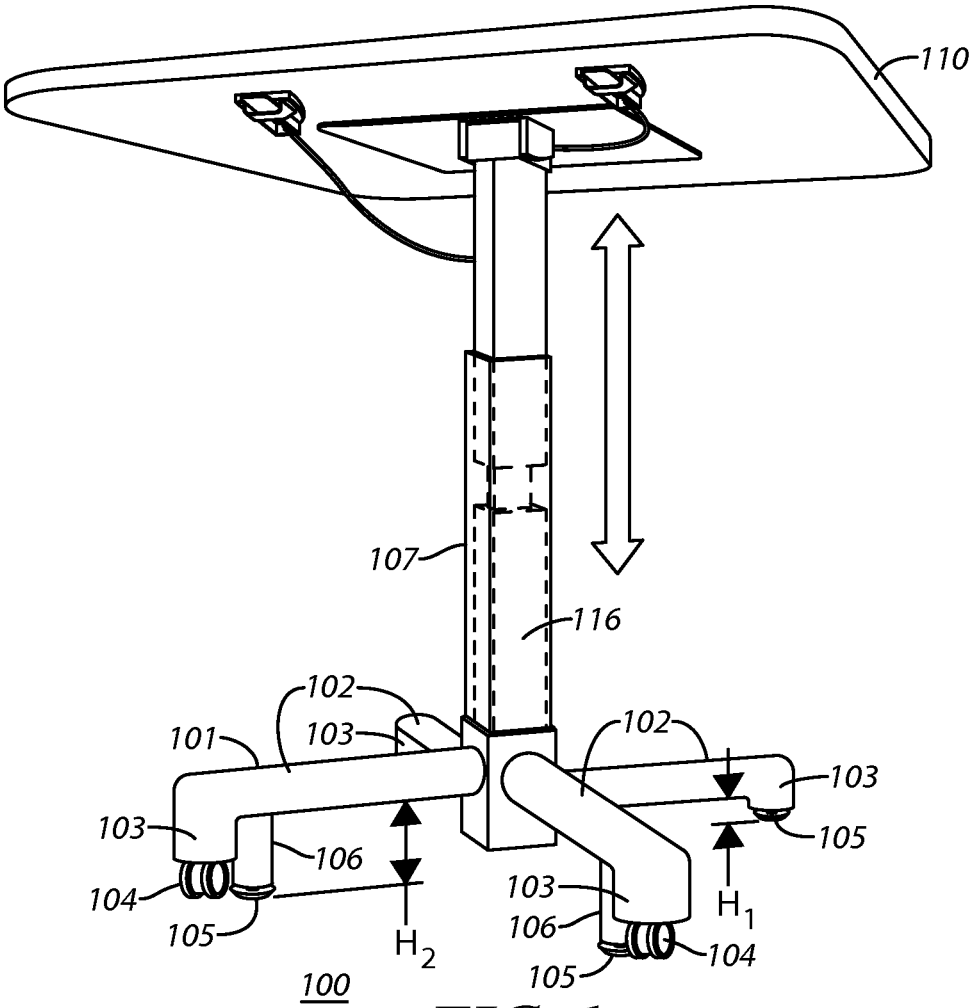
FIG. 1 comprises a perspective view as configured in accordance with various embodiments of the invention.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, an article (such as an article of furniture) has a main body, a floor-engagement frame that operably couples to the main body, and a plurality of non-rolling floor-engagement members connected to a floor-side surface of the floor-engagement frame that engage a floor when the article of furniture rests upon the floor in an ordinary state of usage. This article also includes a plurality of rollers that are also connected to the floor-side surface of the floor-engagement frame. These rollers do not engage the floor when the article of furniture rests upon the floor in that aforementioned ordinary state of usage but do engage the floor when the article of furniture is tilted at least some specific amount such as fifteen degrees. So tilted, the article of furniture can then be moved across the floor by rolling on the plurality of rollers.

By one approach the aforementioned non-rolling floor-engagement members comprise leveling glides and the rollers comprise casters. If desired, each of the rollers is disposed proximal to a corresponding one of the non-rolling floor-engagement members (and near, for example, an outermost end of a corresponding beam as comprises a part of the floor-engagement frame).

These teachings are highly flexible in practice. By one approach, for example, the article of furniture can further comprise (in lieu of the foregoing or in combination therewith), a pedestal that couples to the floor-engagement frame and that supports a table surface. By one approach this table surface can be pivotally coupled to the pedestal. A user interface can be mounted to an underside surface of the table surface (or elsewhere as desired) that controls a latch that serves to hold the table surface in a perpendicular orientation with respect to the pedestal and that permits the table surface to move to a parallel orientation with respect to the pedestal when unlatched. So configured, a user can selectively move that table surface from the perpendicular orientation to the parallel orientation to thereby facilitate, for example, compactly storing a plurality of such articles of furniture in an interleaved manner.

As another example with respect to the flexibility of these teachings, by one approach the article of furniture can include a user interface (which again may connect to an underside surface of the aforementioned table surface) to control a latch that holds the table surface at a present vertical height when latched and that permits the table service to be selectively moved to a different vertical height when unlatched by the user. If desired, a biasing member (such as a pneumatic biasing member) can serve to urge the table surface upwardly and away form the aforementioned floor-engagement frame to thereby facilitate such adjustments.

If desired, one or more visually-discernable images can be disposed on the floor-engagement frame beneath one or more of the aforementioned user interfaces to thereby signal to a user a present location of the user interface on the underside of the table surface.

These and other benefits may become clearer upon making a thorough review and study of the following detailed description. Referring now to the drawings, and in particular to FIG. 1, an illustrative article of furniture that is compatible with many of these teachings will now be presented. In this example, and for the sake of illustration, the article of furniture comprises a table 100. The specifics of this example are not to be taken, however, as suggesting any particular limitations as regards these teachings. Many of the concepts are readily applied, for example, to carts, bars, serving platforms, and so forth as desired.

In this illustrative example the table 100 includes a floor-engagement frame 101 that comprises a plurality of beams 102. As illustrated there are four such beams 102 and they are each disposed perpendicular to the beams 102 that are immediately adjacent on either side thereof. It will be understood that a fewer or greater number of beams 102 can be utilized as desired. These beams 102 can be formed of any material that may be appropriate to a given application setting. Steel or aluminum, for example, can serve well in these regards for many purposes.

In this example the beams 102 meet at a central point and extend outwardly therefrom to an outermost end. Accordingly, viewed from above or from below these beams 102 in this example form a plus sign. Again, these teachings are highly flexible in these regards. Just as there may be a greater or smaller number of beams 102, these teachings will accommodate using beams that are not all of an identical length or that are not linear in shape. These teachings will also accommodate using other shapes for the floor-engagement frame 101 such as, but not limited to, squares, rectangles, circles, ovals, pentagons, and so forth as desired.

In this illustrated example a short leg 103 is formed at the outermost end of each beam 102 and extends downwardly. This short leg 103 includes a threaded opening (not shown) axially disposed therein to receive a threaded engagement member (not shown). In this example two of these short legs 104 so connect to a roller 104 (such as a caster as is known in the art) while the remaining two short legs 103 each connect to a non-rolling floor-engagement member 105 that comprises a leveling glide as is known in the art. Also in this example the two beams 102 that have the rollers 104 also have a non-rolling floor-engagement member 105 disposed proximal (i.e., in this example, within one or two inches) to a corresponding one of the rollers 104 via a support leg 106 that is attached to and extends downwardly from the corresponding beam 102.

Figure 2:
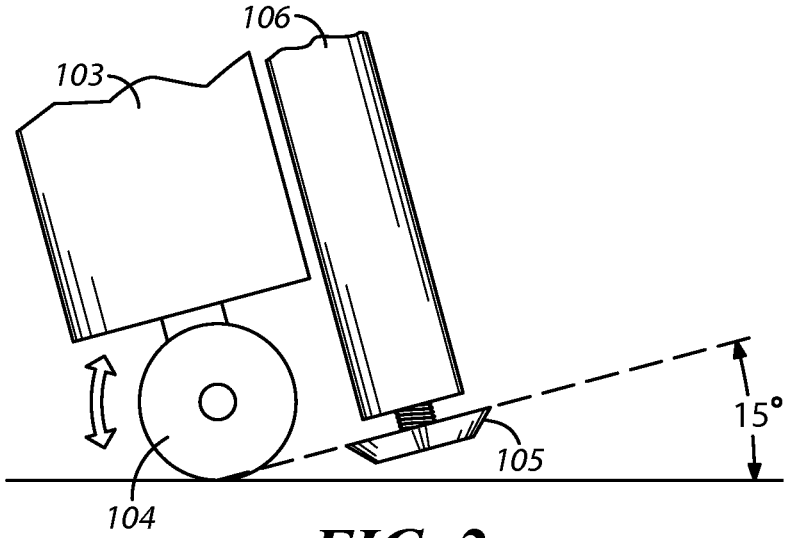
FIG. 2 comprises a side elevational detail view as configured in accordance with various embodiments of the invention.

Referring now to both FIGS. 1 and 2, it can be seen that when the table 100 is resting in an ordinary position of use, all four of the non-rolling floor-engagement members 105 contact the floor while none of the rollers 104 contact the floor. By tilting the table 100 at least a predetermined amount (such as, for example, at least fifteen degrees, or at least thirty degrees, or at least some other appropriate angle of choice), however, the rollers 104 then contact the floor while the corresponding and adjacent non-rolling floor-engagement members 105 are removed from contact with the floor.

Figure 3:
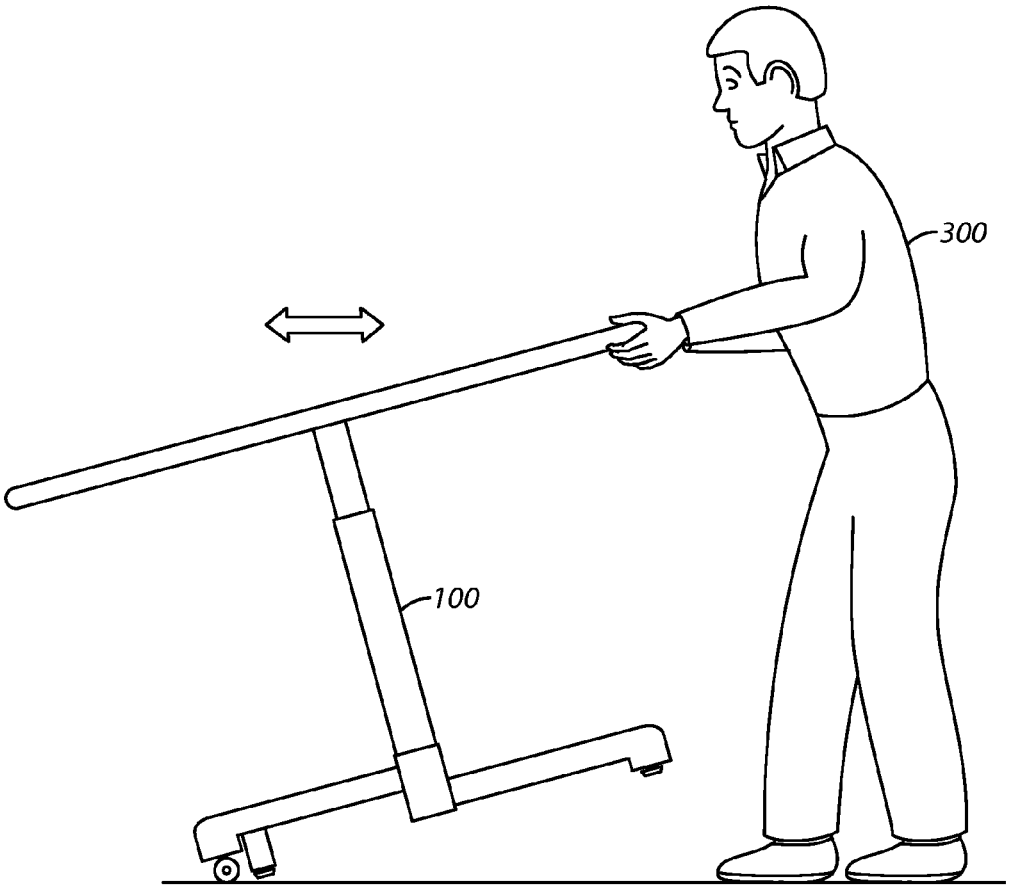
FIG. 3 comprises a side elevational view as configured in accordance with various embodiments of the invention.

So configured, the non-rolling floor-engagement members 105 for each beam 102 engage the floor upon which the table 100 rests when the table 100 is in an ordinary state of usage. The plurality of rollers 104, in turn, do not engage the floor when the table is resting upon the floor in that ordinary state of usage. Accordingly, the rollers 104 are not in a position to facilitate moving the table 100 during ordinary use of the table 100 and this can help to facilitate maintaining a present position of the table 100 during use. Referring now to FIG. 3, however, when an attendant 300 tilts the table 100 at least by the requisite amount (such as the described fifteen degrees), the rollers 104 engage the floor and the non-rolling floor-engagement members 105 disengage from the floor to permit the attendant 300 to move the table 100 across the floor by rolling on that plurality of rollers 104 without resistance between the floor and any of the non-rolling floor-engagement members 105.

Figure 4:
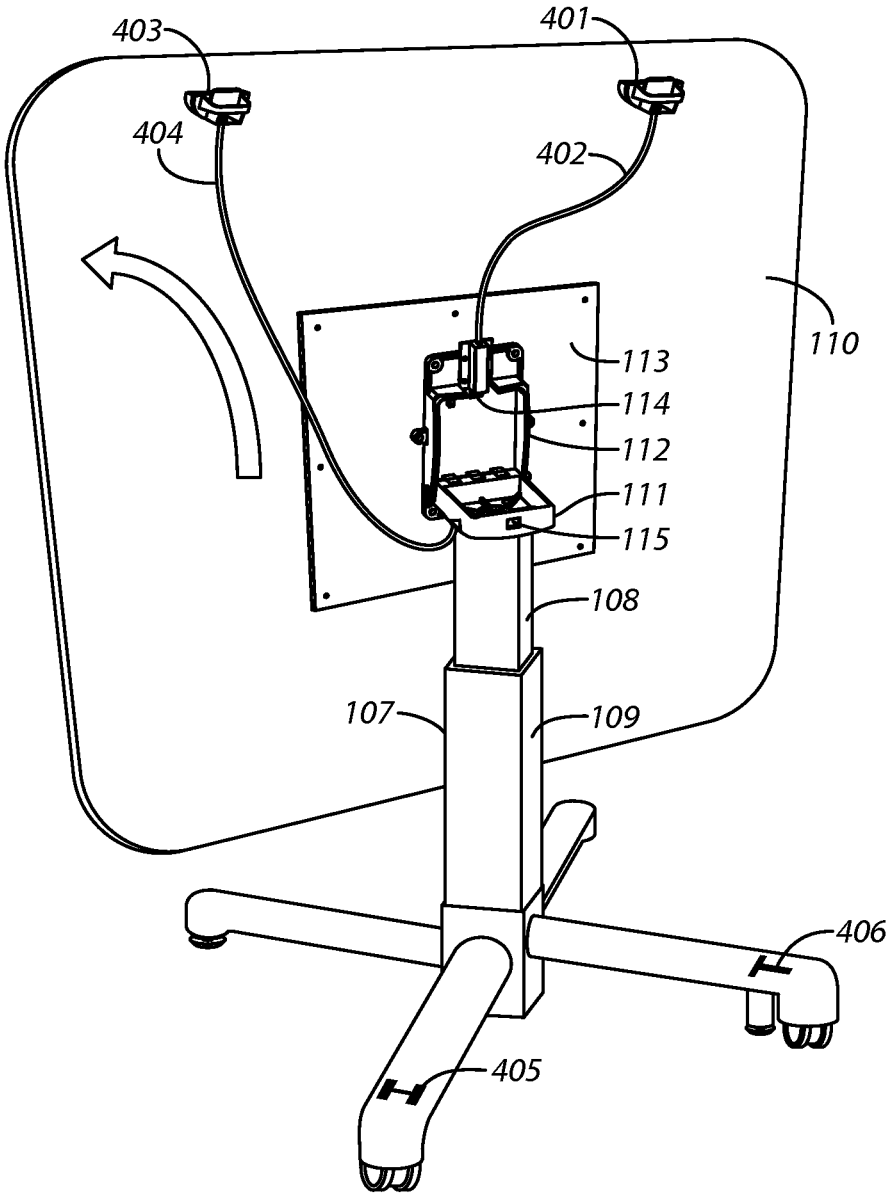
FIG. 4 comprises a perspective view as configured in accordance with various embodiments of the invention.

Referring now to FIGS. 1 and 4, the floor-engagement frame 101 operably couples to a main body 107. In this illustrative example the main body 101 includes a pedestal 108 and a corresponding pedestal receiver 109. The pedestal receiver 109 comprises a hollow cylinder that connects to the center of the floor-engagement frame 101. This hollow cylinder, in this example, has a square cross-section. The pedestal 108, in turn, comprises a member having a square cross-section that is slightly smaller in size that the cross-section of the pedestal receiver 109. So configured, the pedestal 108 can slide up and down within the pedestal receiver 109 without undue looseness or lateral play.

Figure 5:
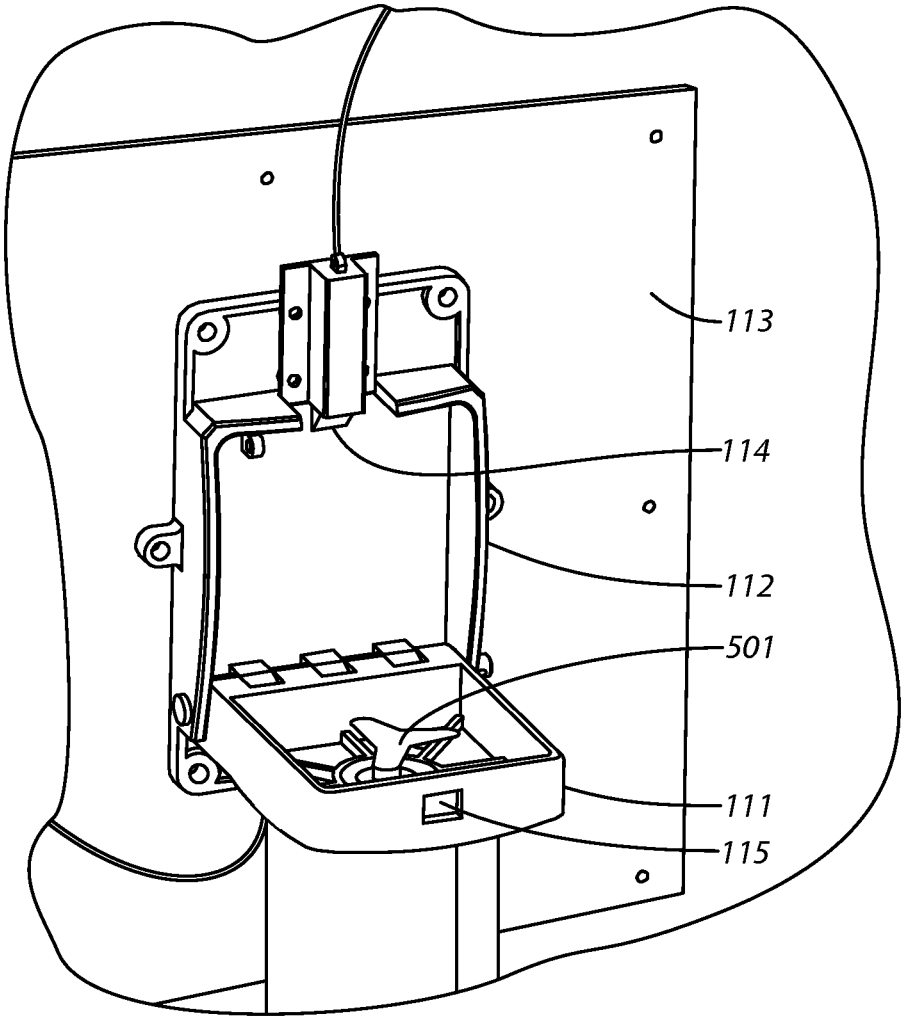
FIG. 5 comprises a bottom-side perspective detail view as configured in accordance with various embodiments of the invention.

The pedestal 108, in turn, operably couples to a table surface 110 that comprises another component of the table 100. In this illustrative example the underside of the table surface 100 pivotally connects to the pedestal 108. With reference in particular to FIGS. 4 and 5, this pivot assembly comprises a first portion 111 that connects in a fixed manner to the pedestal 108 and a second portion 112 that connects via a support plate 113 to the underside of the table surface 110. This first and second portion 111 and 112 are pivotally connected to one another, for example, by a corresponding pin or hinge as desired.

So configured, the table surface 110 can be selectively disposed in a first position where the table surface 110 is in a perpendicular orientation with respect to the pedestal 108 (as shown for example, in FIG. 1). By pivoting the table surface 110 with respect to the pedestal 108, however, the table surface 110 is selectively moved ninety degrees to a parallel orientation with respect to the pedestal 108 (as shown for example in FIGS. 4 and 5).

Tilting the table surface 100 to the upright, parallel orientation can facilitate, for example, storing the table 100 in a small space and/or storing a plurality of such tables 100 in a relatively small storage area. By one approach, and as illustrated in FIG. 1, two adjacent beams 102 as comprise the floor-engagement member 102 can be higher than the remaining two beams 102. In this particular illustrated example, it is the two beams 102 that have the rollers 104 that are disposed $H_2$ above the floor whereas the two beams 102 that only feature the non-rolling floor-engagement members 105 are disposed $H_1$ above the floor (where $H_2$ is higher than $H_1$). Or, if desired, all of the beams 102 can have a same height above the floor. Applying a common height to all beams 102 can be useful, for example, when seeking to maintain a low profile while also accommodating wheelchair paddle feet that might conflict with higher profile beams 102.

By having the underside of the higher beams 102 higher than the top sides of the lower beams 102, one can easily slide the lower beams 102 of a second table (not shown) beneath the higher beams 102 of a first table to thereby interleave the beams 102 of these two tables to thereby place their respective main bodies 107 close to one another. The latter proximity, in turn, becomes possible because the beams 102 not only interleave as described but also because the table surface 110 can tilt as described to thereby prevent the table surfaces 110 of the two tables 100 from contacting or otherwise interfering with one another. Properly interleaved with one another as described, the table surfaces 110 of these various tables 100 will be at least substantially parallel to one another.

Figure 6:
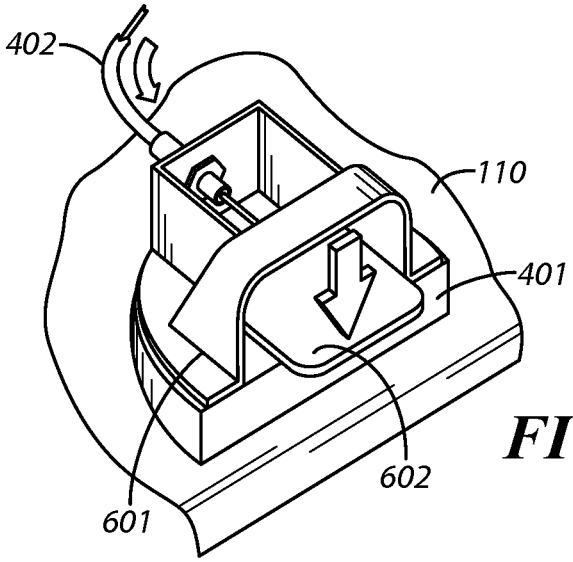
FIG. 6 comprises a top-side perspective detail view as configured in accordance with various embodiments of the invention.

By one approach, and referring now to FIGS. 4-6, a latch 114 can be provided on the second portion 112 of the pivot assembly that selectively engages and thereby interlocks with a corresponding catch opening 115 formed in the first portion 111 of the pivot assembly when the table surface 110 is in the aforementioned perpendicular orientation. This latch may comprise, for example, a pull-based design or a lever-based design as desired (with both such approaches been well known in the art).

When the latch 114 so engages this catch opening 115, the first and second portions 111 and 112 of the pivot assembly are no longer free to pivot and this, in turn, causes the table surface 110 to be held in the perpendicular orientation. By switching the latch 114 to an unlatched state, however, the latch 114 is removed from the catch opening 115 and the table surface 110 can now be freely tilted to the aforementioned parallel orientation with respect to the pedestal 108.

If desired, a first user interface 401 can be mounted to the underside of the table surface 110 proximal to one edge thereof (for example, within two to four inches of that edge). This first user interface 401 can couple to the aforementioned latch 115 by a corresponding cable 402. With particular momentary reference to FIG. 6, this first user interface 401 can be functionally similar, for example, to the common bicycle hand brake. In this case, the first user interface 401 includes a base assembly 601 that pivotally captivates a paddle 602. This paddle 602 in turn connects to the aforementioned cable 402. So configured, urging the paddle 602 towards the table surface 110 pulls the cable 402 and thereby retracts the aforementioned latch 114 from its catch opening 115. Unlatching the latch 114, of course, now permits the table surface 110 to be moved to its tilted position.

If desired, the paddle 602 can be biased (for example, via one or more spring mechanisms (not shown)) to urge the paddle 602 away from the table surface 110. Urging the paddle 602 away from the table surface 110 will, in turn, push the cable 402 back towards the latch 114 and hence will urge the latch 114 towards a latched position when the latch 114 is otherwise disposed proximal to the catch opening 115.

As noted above, by one approach the pedestal 108 can move up and down vertically in the pedestal receiver 109. For some application settings it may be sufficient that these two components fit snuggly such that friction alone is sufficient to hold the table surface 110 at a desired height. These teachings will accommodate other approaches in these regards, however.

By one approach, for example, a biasing member (such as a pneumatic biasing member 116 as shown in FIG. 1) can be disposed within the pedestal receiver 109 and operably coupled to the pedestal 108 to urge the table surface 110 upwardly and away from the floor-engagement frame 101. Generally speaking, the strength of this upwardly-directed bias need not be large. It will be sufficient for many application settings if the bias is sufficient to assist an attendant who seeks to raise the table surface 110 while not presenting an uncomfortable resistance against that same attendant who seeks to lower the table surface 110 by pressing down on the table surface 110. These teachings will also accommodate, if desired, a more neutral bias setting, such that the biasing member is only of a sufficient strength to counteract the downward force of gravity that acts upon the table surface 110 but is not otherwise individually sufficient to move the table surface 110 upwardly from a given present height.

Figure 7:
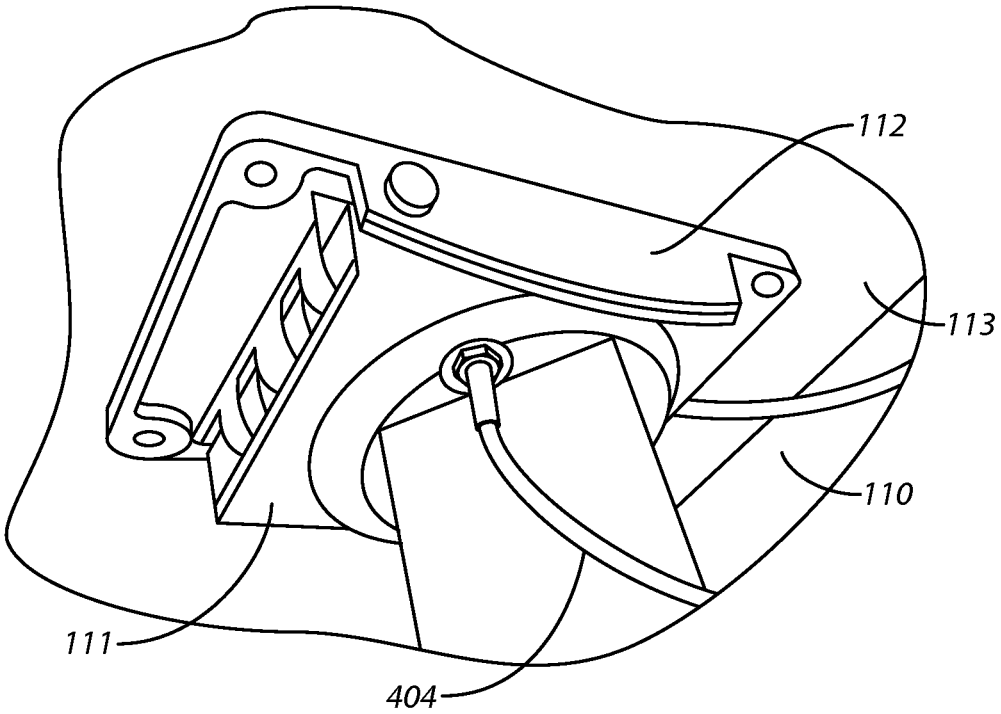
FIG. 7 comprises a bottom-side perspective detail view as configured in accordance with various embodiments of the invention.

If desired, and referring now to FIGS. 4, 5, and 7, another latch 501 can be provided to hold the table surface 110 at a present vertical height when in a latched state. Placing this latch 501 into an unlatched state will, in turn, permit the table surface 110 to be selectively moved to a different vertical height. This latch 501 can comprise either of a pull-based latch or a push-based latch as desired. By one approach this latch 501 actuates the pneumatic biasing member 116 in the pedestal receiver 109 to thereby allow the user to adjust the height to a desired height using only minimal effort so long as the latch 501 is actuated.

Also if desired, this latch 501 can again be made responsive to a second user interface 403 that again couples, in this illustrative example, to the underside surface of the table surface 110 (or elsewhere as desired) and that couples via a corresponding control cable 404 to this latch 501. This second user interface 403 can be identical in form and substance to the earlier-described first user interface 401 if desired.

As yet another optional approach in these regards, yet another latch (not shown) having a corresponding user interface (not shown) akin to those described herein can serve to help prevent unintended changes to the table surface 110 height. This optional latch can serve, for example, to interact with a hole in the control cable 404 to prevent that control cable 404 from moving even if the user should engage the latch 501 for that control cable 40. This optional latch can therefore serve as a user-operable safety lock to lock the latch 501 in the latched state and prevent that latch 501 from inadvertently switching to the unlatched state.

By one approach these user interfaces 401 and 403 are disposed on the underside of the table surface 110 and proximal to a shared edge of that table surface 110 with the hand-engageable paddles 602 facing outwardly towards the attendant 300. If desired, one or both of these user interfaces 401 and 403 can be disposed proximal to a particular corner of the table surface 110 (where either both user interfaces 401 and 403 are located near the same corner or where one or both are located proximal to separate corners). So configured, an attendant 300 can easily manipulate either or both of the user interfaces 401 and 403 while also gripping and otherwise holding or pressing upon that table surface 110 when seeking to tilt and/or raise/lower that table surface 110.

While locating these user interfaces 401 and 403 on the underside of the table surface 110 renders those interfaces readily accessible and further contributes to the aesthetic appearance of the table 100, in some cases this location may make it somewhat more challenging for the attendant to locate them at a time of need (especially if the table surface 110 is already at its lowest available height). It is also possible that the attendant might become uncertain as to which user interface controls tilting of the table surface 110 and which controls adjusting the height of the table surface 110.

Accordingly, if desired and as shown in FIG. 4, these teachings will accommodate placing one or more visually-discernable images 405 and 406 on the floor-engagement frame 101 and beneath, for example, a corresponding user interface 401 or 403 (which may comprise, for example, placing such images 405 and 406 beneath a particular corner of the table surface 110 as corresponds to the location of these interfaces 401 and 403). By one approach this can comprise placing such images 405 and 406 at or near the outermost ends of the beam 102 or beams 102 that most closely correspond to the indicated user interface 401 and/or 403.

These images 405 and 406 can comprise alphanumeric characters (such as, by way of illustration and not by way of limitation, the letter "H" for the user interface 403 that facilitates adjusting height and the letter "T" for the user interface 401 that facilitates adjusting the tilt of the table surface 110) and/or graphic images, icons, or the like as desired. These images 405 and 406 can be formed as part of the floor-engagement frame 101 (for example, as a part of a molded beam 102) or can be applied via paint or ink or as an applied sticker, decal, or the like as desired.

Figure 8:
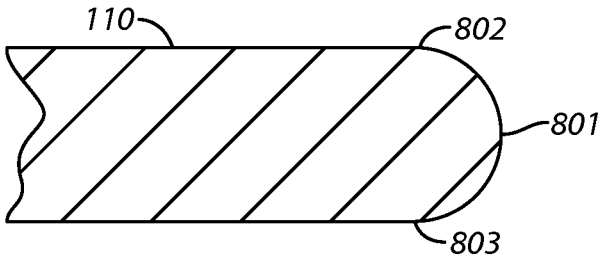
FIG. 8 comprises a side elevational cutaway detail view as configured in accordance with various embodiments of the invention.

The table surface 110 itself can be comprised of any of a variety of materials including plastic, wood, metal, or any of a variety of composite and/or laminated substrates as desired. By one approach, as shown in FIG. 8, the table surface 110 can have a rounded-edge periphery 801. This rounded-edge periphery 801 can include, as desired, both a rounded upper edge 802 and a rounded lower edge 803. Rounded edges, in turn, can contribute both to the aesthetic appeal of the table 100 as well as a pleasant and non-challenging interaction with persons seated at the table 100 who may rest their arms upon the table surface 110 in a way that overlays that edge 801.

So configured, an article of furniture (such as, but not limited to, a table) can be easily rolled from place to place while also tending to stay located in an installed state such that the article will resist sideways movement during ordinary use. A table surface for such an article can be readily adjusted in height and by only a single attendant if desired. The table surface can be tilted to a vertical orientation that reduces the article's corresponding storage footprint and that can work in cooperation with an interleaving floor-engagement member configuration to permit a plurality of such articles to be closely interleaved with one another to again reduce their aggregate storage footprint. The user interfaces to facilitate such adjustability can themselves be secreted from ordinary view while nevertheless remaining conveniently located to facilitate their successful usage.

These teachings are highly flexible in practice and will accommodate a wide variety of variations. The concepts set forth herein are also highly scalable in practice and will accommodate not only a variety of different types of articles of furniture but also differently-shaped and differently-sized articles of the same type (such as, for example, tables having smaller or larger table surfaces, tables having round or oval-shaped table surfaces, or tables having a smaller or larger vertical adjustment capability, to note but a few examples in these regards.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

I claim:

1. An apparatus comprising:

an article of furniture, comprising:

a main body;

a floor-engagement frame having a central portion attached to the main body;

a plurality of non-rolling floor-engagement members connected to a floor-side surface of the floor-engagement frame and configured to engage a floor when the article of furniture rests upon the floor in an ordinary state of usage wherein each of the non-rolling floor-engagement members is radially outward of the central portion;

a plurality of rollers connected to the floor-side surface of the floor-engagement frame radially outwardly of the plurality of non-rolling floor-engagement members and configured to not engage the floor when the article of furniture rests upon the floor in the ordinary state of usage, wherein the plurality of rollers are spatially discrete with respect to the plurality of non-rolling floor-engagement members and hence not spatially intermingled with any of the non-rolling floor-engagement members; and wherein each of the non-rolling floor engagement members is spaced radially inwardly from an innermost portion of one of the rollers;

such that when the floor-engagement frame tilts by at least fifteen degrees towards a moving state of usage, the plurality of rollers engage the floor and the non-rolling floor-engagement members disengage from the floor to permit rolling movement of the article of furniture.

2. The apparatus of claim 1 wherein at least some of the plurality of non-rolling floor-engagement members comprise leveling glides.

3. The apparatus of claim 1 wherein at least some of the plurality of rollers comprise casters.

4. The apparatus of claim 1 wherein each of the rollers is disposed proximal to a corresponding one of the non-rolling floor-engagement members.

5. The apparatus of claim 1 wherein the floor-engagement frame comprises four beams, wherein each of the beams is disposed perpendicular to both adjacent beams and has an outermost end, and wherein the non-rolling floor-engagement members and the rollers are disposed proximal to the outermost end of corresponding beams.

6. The apparatus of claim 1 wherein the article of furniture comprises a table.

7. The apparatus of claim 6 wherein the main body comprises:

a pedestal that couples to the floor-engagement frame;

a table surface that couples to the pedestal.

8. The apparatus of claim 7 wherein the table surface is pivotally coupled to the pedestal.

9. The apparatus of claim 8 further comprising:

a user interface coupled to an underside surface of the table surface;

a latch responsive to the user interface, the latch having a latched state that holds the table surface in a perpendicular orientation with respect to the pedestal and an unlatched state that permits the table surface to move to a parallel orientation with respect to the pedestal;

such that a user can selectively move the table surface from the perpendicular orientation to the parallel orientation by employing the user interface to unlatch the latch.

10. The apparatus of claim 9 wherein the user interface is disposed proximal to a particular corner of the table surface.

11. The apparatus of claim 10 wherein the floor-engagement frame has a visually-discernable image disposed thereon beneath the particular corner of the table surface to thereby signal to a user a present location of the user interface.

12. The apparatus of claim 11 wherein the floor-engagement frame comprises four beams, wherein each of the beams is disposed perpendicular to both adjacent beams and has an outermost end, and wherein the visually-discernable image is disposed at one of the outermost ends.

13. The apparatus of claim 7 further comprising:

a user interface coupled to an underside surface of the table surface;

a latch responsive to the user interface, the latch having a latched state that holds the table surface at a present vertical height and an unlatched state that permits the table surface to be selectively moved to a different vertical height;

such that a user can selectively move the table surface to different vertical heights by employing the user interface to unlatch the latch.

14. The apparatus of claim 13 further comprising:

a biasing member configured to urge the table surface upwardly and away from the floor-engagement frame.

15. The apparatus of claim 14 wherein the biasing member comprises, at least in part, a pneumatic biasing member.

16. The apparatus of claim 13 wherein the user interface is disposed proximal to a particular corner of the table surface.

17. The apparatus of claim 16 wherein the floor-engagement frame has a visually-discernable image disposed thereon beneath the particular corner of the table surface to thereby signal to a user a present location of the user interface.

18. The apparatus of claim 17 wherein the floor-engagement frame comprises four beams, wherein each of the beams is disposed perpendicular to both adjacent beams and has an outermost end, and wherein the visually-discernable image is disposed at one of the outermost ends.

19. The apparatus of claim 7, wherein the table surface has a rounded-edge periphery.

20. The apparatus of claim 19 wherein the rounded-edge periphery includes both a rounded upper edge and a rounded lower edge.

* * * * *

UNITED STATES PATENT AND TRADEMARK OFFICE

CERTIFICATE OF CORRECTION

PATENT NO. : 9,144,300 B2
APPLICATION NO. : 13/523415
DATED : September 29, 2015
INVENTOR(S) : Richard S. Cotey It is certified that error appears in the above-identified patent and that said Letters Patent is hereby corrected as shown below:

ON THE TITLE PAGE:

Item 54, and in the Specification, Column 1, Title of Application: Delete "Application" and insert -- Apparatus --, therefor.

IN THE CLAIMS:

Claim 1, Column 8, Line 3: Delete "usage" and insert -- usage, --, therefor.

Signed and Sealed this
Fifth Day of April, 2016

Michelle K. Lee

Michelle K. Lee
*Director of the United States Patent and Trademark Office*